US006478629B1

(12) United States Patent
Li et al.

(10) Patent No.: US 6,478,629 B1
(45) Date of Patent: Nov. 12, 2002

(54) AUDIO JACK HAVING SIDE MOUNT GROUNDING TERMINAL

(75) Inventors: Chun Sheng Li, Kunsan (CN); Guang Xing Shi, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/041,077

(22) Filed: Dec. 28, 2001

(51) Int. Cl.[7] ..... H01R 24/04
(52) U.S. Cl. ..... 439/668
(58) Field of Search ..... 439/668, 669, 439/108, 188

(56) References Cited

U.S. PATENT DOCUMENTS 5,919,052 A * 7/1999 Ho ..... 439/668
6,220,898 B1 * 4/2001 Wu ..... 439/668
6,224,408 B1 * 5/2001 Wu ..... 439/188

* cited by examiner

*Primary Examiner*—Tho D. Ta
(74) *Attorney, Agent, or Firm*—Wei Te Chung

(57) ABSTRACT

An audio jack includes an insulative casing (6) inside which conductive terminals (1, 2, 3, 4) and a side mount grounding terminal (5) are disposed. The casing has a front face (60), a rear face (64), a pair of opposite side faces (62, 63), and a bottom wall (67) defining a recess (610) in an inner side thereof. An interior space (601) is defined in the casing. One side face of the casing defines a window (609) communicated with the interior space via the recess and a slit (608) communicated with the window. The grounding terminal includes a horizontal plate portion (53) received in the slit, an upwardly extending contact portion (51) extending through the window and projecting into the interior space through the recess, and a solder pad (52).

2 Claims, 6 Drawing Sheets

AUDIO JACK HAVING SIDE MOUNT GROUNDING TERMINAL

BACKGROUND OF THE INVENTION

1. Field of the Invention

The present invention relates to an audio jack, and particularly to an audio jack having a side mount grounding terminal for engaging with an audio plug.

2. Description of Related Art

U.S. Pat. No. 6,056,602 discloses a conventional audio jack 9 with a top loading grounding terminal 92 shown in FIG. 6. The grounding terminal 92 has a center portion 923, an elongate portion 920 inwardly extending from an upper edge of the center portion 923, and a solder pad 921 outwardly extending from a lower edge of the center portion 923. A stepped engaging portion 922 ends from the elongate portion 920. The grounding terminal 92 is adapted to be mounted to a body 90 with the center portion 923 received in a first fixing groove 902 and the elongate portion 920 received in a second fixing groove 903. The engaging portion 922 of the grounding terminal 92 extends into an opening 904 in a top wall 900 of the body 90 for contacting a corresponding portion of an inserted audio plug (not shown) for grounding. The opening 904 is defined at the junction of a front wall 901 and a sleeve 91 projecting from the front wall 901. Therefore, the opening 904 reduces the strength of the front wall 901 and the sleeve 91. When the audio plug is frequently inserted into or pulled out of the audio jack, the sleeve 91 and the body 90 must bear certain stress. Accordingly the sleeve 91 is easy to break after repeated insertions of the audio plug or especially when a vertical force is applied thereto due to the position of the opening 904.

Therefore, an audio jack having a side mount grounding terminal is desired to increase the strength of a sleeve thereof.

SUMMARY OF THE INVENTION

Accordingly, the object of the present invention is to provide an audio jack for receiving an audio plug, the audio jack having a side mount grounding terminal for increasing the strength of a sleeve thereof.

In order to achieve the object set forth, an audio jack of the present invention comprises an insulative casing inside which a plurality of conductive terminals and a grounding terminal are disposed. The casing has a front face, a rear face, a pair of opposite side faces, and a bottom wall defining a recess in an inner side thereof. An interior space is defined in the casing. The front face has a sleeve formed thereon and defined a channel in communication with the interior space for receiving a pin of a mating plug for audio signals transmission. One side face of the casing defines a window communicated with the interior space via the recess and a slit communicated with the window. The grounding terminal comprises a horizontal plate portion received in the slit, an upwardly extending contact portion extending through the window and projecting into the interior space through the recess, and a solder pad for being mounted on a printed circuit board.

Other objects, advantages and novel features of the invention will become more apparent from the following detailed description of the preferred embodiment when taken in conjunction with the accompanying drawings.

DETAILED DESCRIPTION OF THE INVENTION

Figure 1:
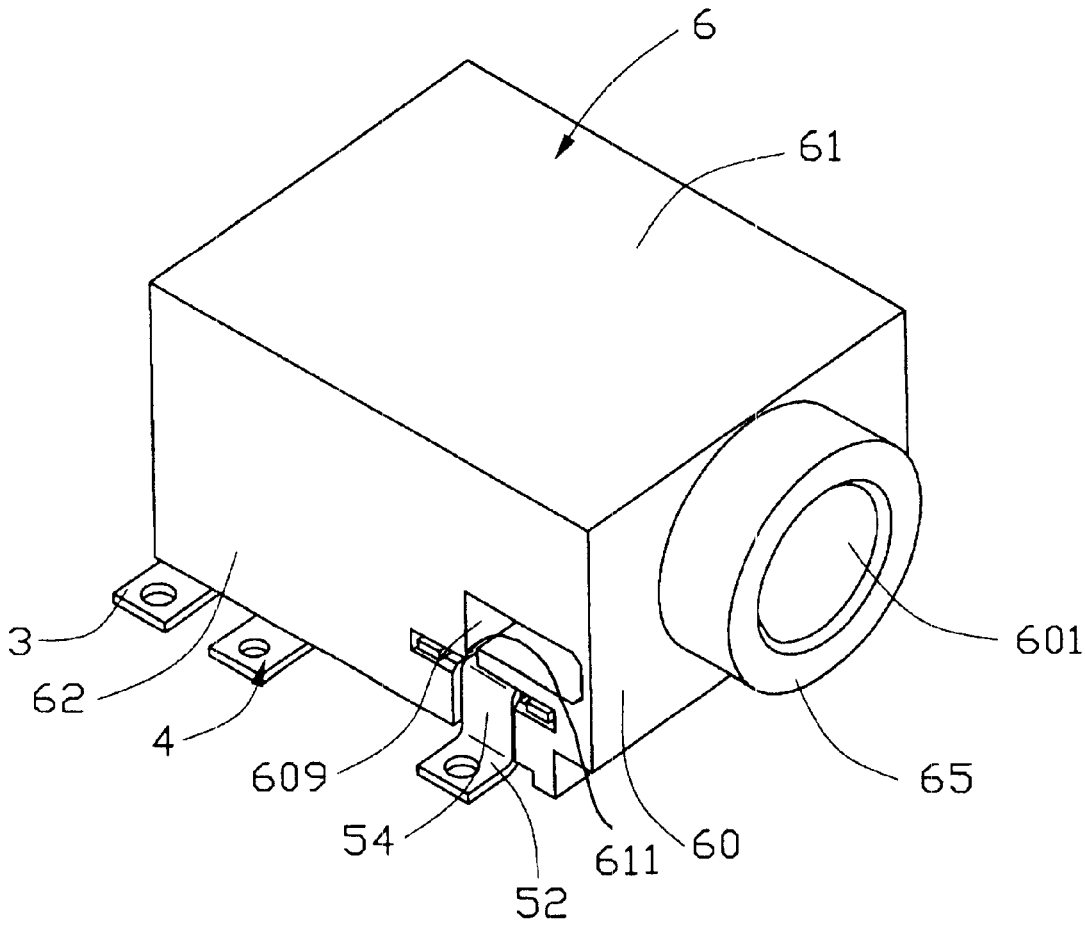
FIG. 1 is a perspective view of an audio jack of the present invention.

Reference will now be made to the drawing figures to describe the present invention in detail.

Figure 2:
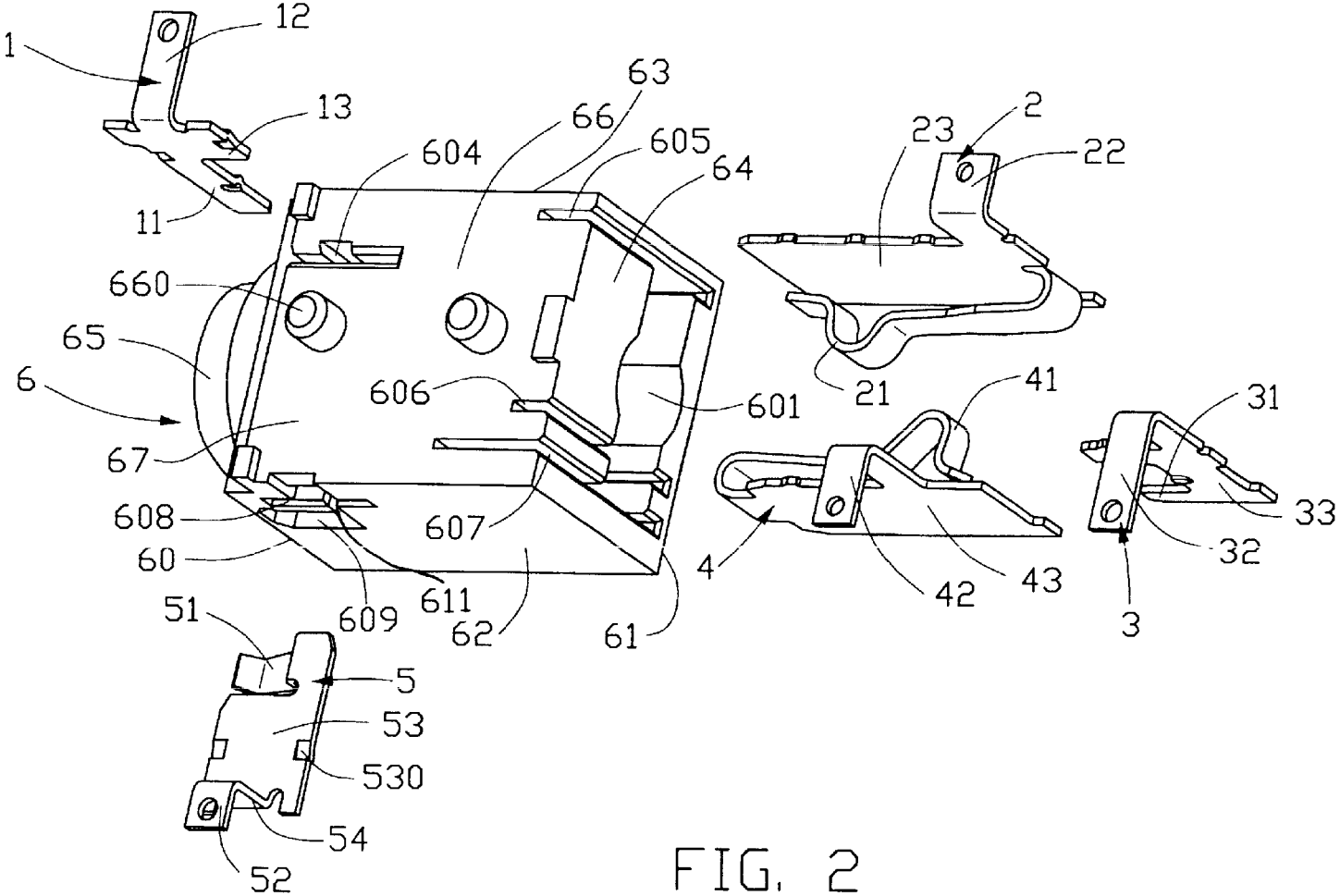
FIG. 2 is a bottom perspective view of the audio jack of the present invention with five terminals thereof separated.
Figure 3:
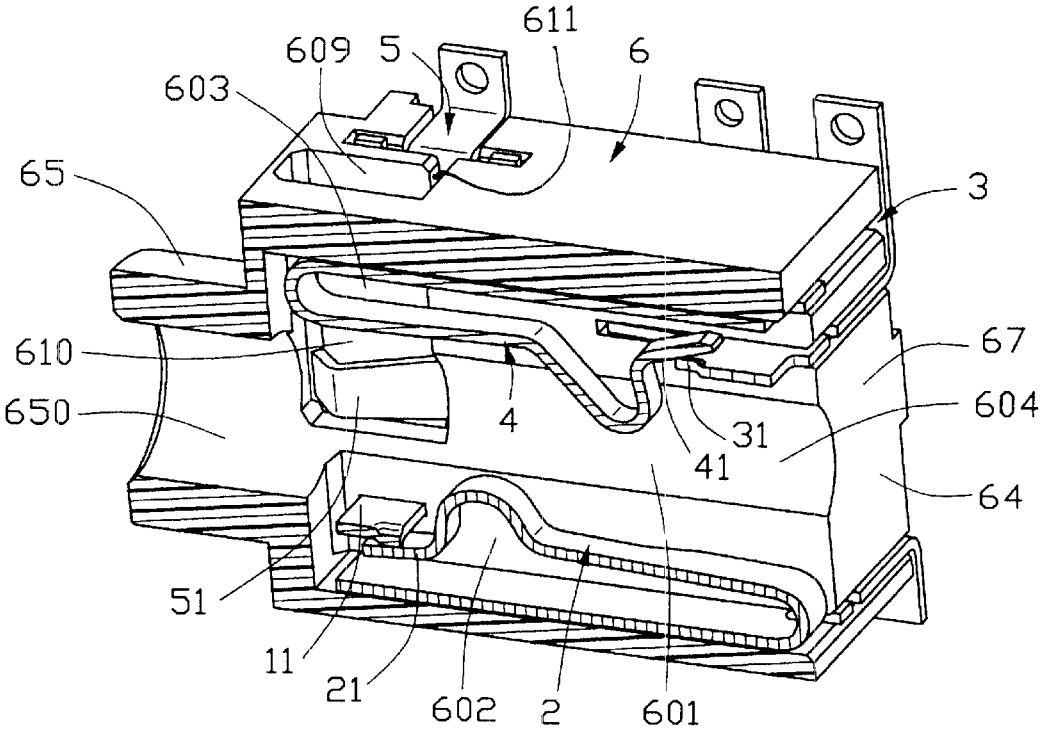
FIG. 3 is a cross-sectional view of the audio jack in FIG. 1.
Figure 4:
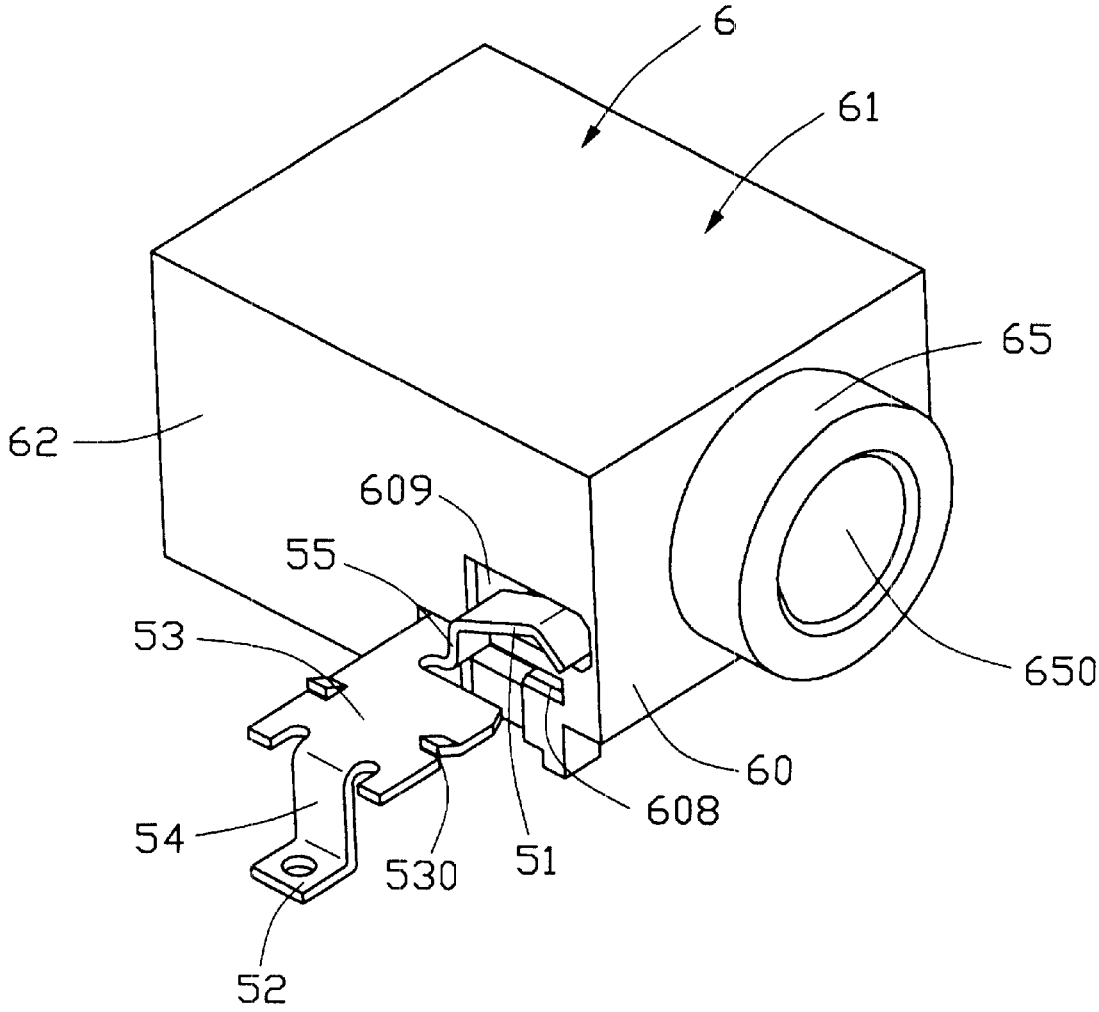
FIG. 4 is a perspective view of the audio jack with a side mount grounding terminal thereof separated.

Referring to FIGS. 2 and 3, an audio jack constructed in accordance with the present invention. The audio jack comprises an insulative casing 6 inside which signal and detecting terminals 1, 2, 3, 4 and a side mount grounding terminal 5 are disposed. The casing 6 has a top face 61 and a bottom wall 67 defining a bottom face 66 connected by a front face 60, a rear face 64, and left, right side faces 62, 63. The bottom wall 67 defines a recess 610 in an inner side thereof. An interior space 601 is defined in the casing 6. The front face 60 has a sleeve 65 formed thereon and defining a channel 650 (FIG. 4) in communication with the interior space 601 for receiving a pin of a mating plug 7 for audio signals transmission. The left side face 62 defines a window 609 communicating with the interior space 601 via the recess 610, and a slit 608 communicating with the window 609 via a vertical groove 611.

The bottom face 66 of the casing 6 has positioning pins 660 formed thereon. The positioning pins 660 are receivable in holes defined in a substrate (such as a printed circuit board) for positioning purposes.

The casing 6 has two sets of slots. The first set of slots includes a first movable terminal holding slot 605 in the rear face 64 and a first stationary terminal holding slot 604 in the bottom face 66. The second set of slots includes a second movable terminal holding slot 607 and a second stationary terminal holding slot 606 in the rear face 64. The movable terminal holding slots 605, 607 respectively receive and retain a first movable terminal 2 and a second movable terminal 4 therein, while the stationary terminal holding slots 604, 606 respectively receive and retain a first stationary terminal 1 and a second stationary terminal 3 therein. All the terminals 1, 2, 3, 4 are made of conductive material.

The first and second movable terminals 2, 4 are U-shaped members capable of pre-compression in order to be fit in a first and a second receiving cavities 602, 603 of the interior space 601. A reactive force facilitates retention of the first and second movable terminals 2, 4 in the first and second receiving cavities 602, 603. In this respect, the U shape of the first and second movable terminals 2, 4 is dimensioned to be larger than the width of the first and second receiving cavities 602, 603, thereby requiring pre-compression of the first and second movable terminals 2, 4 before being fit into the first and second receiving cavities 602, 603.

The first, second movable terminal 2, 4 has a plate portion 23, 43 received in the first, second movable terminal holding slot 605, 607, an internal contact portion 21, 41 extending from one end of the plate portion 23, 43, and a solder pad 22, 42 extending out of the casing 6 from a bottom edge of the plate portion 23, 43 for being soldered on the printed circuit board. The internal contact portion 21, 41 of the movable terminal 2, 4 deflectably extends into a middle cavity 604 of the interior space 601.

The first, second stationary terminal 1, 3 comprises an internal contact portion 11, 31, a solder pad 12, 32 extending beyond the casing 6 and a plate portion 13, 33 connecting the internal contact portion 11, 31 with the solder pad 12, 32. The internal contact portion 11, 31 is received in the first, second stationary terminal holding slot 604, 606.

The first and second stationary terminal holding slots 604, 606 are respectively in communication with the first and second receiving cavities 602, 603. The internal contact portions 21, 41 of the first and second movable terminals 2, 4 are resiliently engaged with the internal contact portions 11, 31 of the first and second stationary terminals 1, 3 respectively. The first and second movable terminals 2, 4 are disengageable from the first and second stationary terminals 1, 3 upon insertion of the mating plug 7.

Since the internal contact portions 21, 41 of the first and second movable terminals 2, 4 extend into the middle cavity 604 of the interior space 601, the pin of the mating plug 7 contacts and deflects the internal contact portions 21, 41 of the first and second movable terminals 2, 4. Thus, the internal contact portions 21, 41 of the first and second movable terminals 2, 4 are separated from the internal contact portions 11, 31 of the first and second stationary terminals 1, 3.

Referring to FIGS. 1–4, the grounding terminal 5 includes a plate portion 53, a vertical portion 54 downwardly extending from an edge of the plate portion 53, a rising portion 55 extending upwardly from another edge of the plate portion 53, and a contact portion 51 extending forwardly from an upper end of the rising portion 55. A solder pad 52 extends outwardly from a lower end of the vertical portion 54 for being soldered on the printed circuit board. A pair of resilient tabs 530 is stamped from the plate portion 53 for securing the grounding terminal 5. Preferably, the solder pad 52 of the grounding terminal 5 and solder pads 12, 22, 32, 42 of the terminals 1, 2, 3, 4 are substantially flush with each other for facilitating surface mounting on the printed circuit board. When the grounding terminal 5 is assembled to the casing 6, the contact portion 51 is first inserted into the window 609 and extends upwardly into the interior space 601 through the recess 610 at the bottom of the interior space 601. Then the plate portion 53 is received in the slit 608 with the resilient tabs 530 engaged with an inner side of the casing 6.

Figure 5:
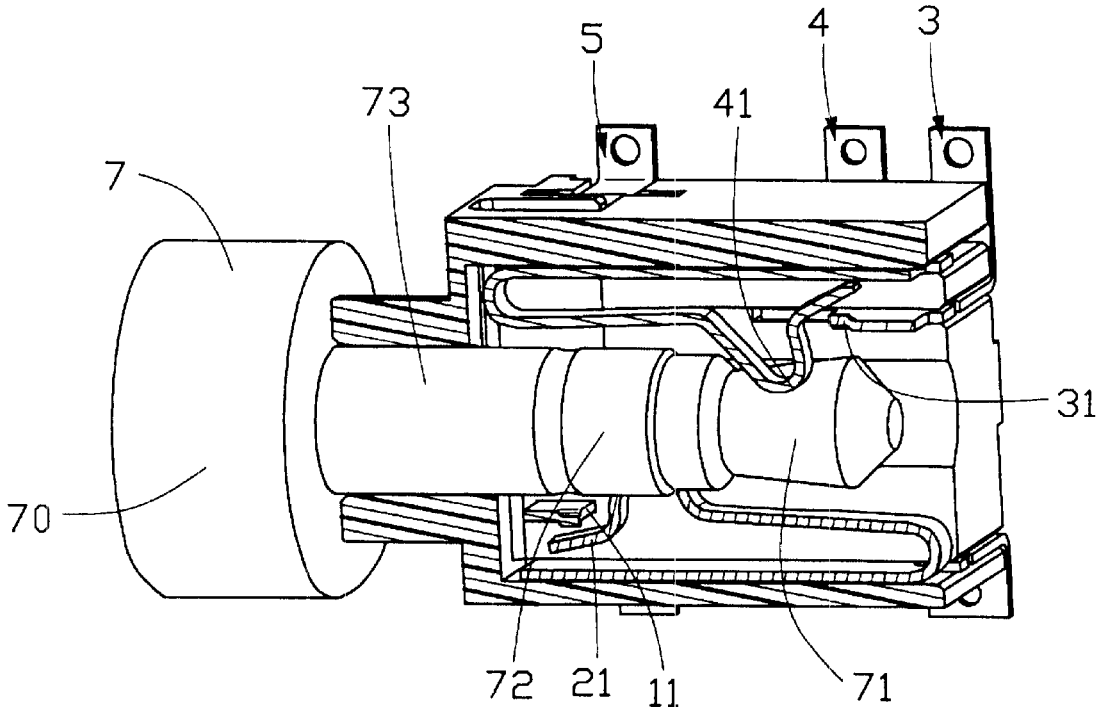
FIG. 5 is a cross-sectional view of the audio jack mated with a mating plug.
Figure 6:
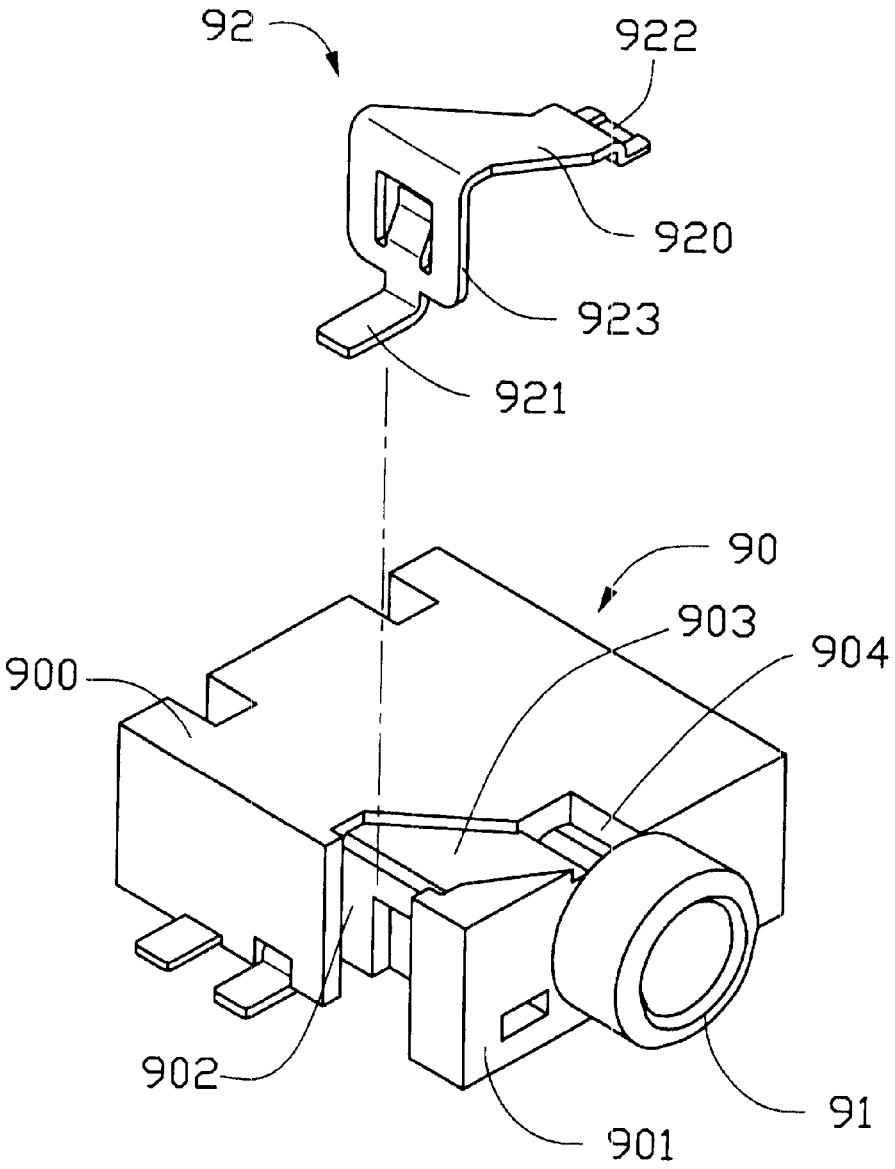
FIG. 6 (PRIOR ART)
FIG. 6 is a perspective view of a conventional audio jack with a top loading grounding terminal thereof separated.

Referring to FIG. 5, the mating plug 7 comprises a base 70, and a pin projecting from a front surface of the base 70. The pin comprises a front portion 71, a rear portion 73, and a middle portion 72 connecting the front portion 71 with the rear portion 73.

In the embodiment illustrated, the front portion 71 of the pin first contacts the grounding terminal 5 during insertion. The front portion 71 and the middle portion 72 of the pin are then brought into contact with the internal contact portions 21, 41 of the first and second movable terminals 2, 4 while the rear portion 73 of the pin contacts the contact portion 51 of the grounding terminal 5 to establish a grounding path. Thus, the internal contact portions 21, 41 of the first and second movable terminals 2, 4 are separated from the internal contact portions 11, 31 of the first and second stationary terminals 1, 3, thereby disconnecting the first and second movable terminals 2, 4 from the first and second stationary terminals 1, 3.

When removing the plug from the audio jack, the resiliency of the internal contact portions 21, 41 allows the first and second movable terminals 2, 4 to resume engagement with the internal contact portions 11, 31 of the first and second stationary terminals 1, 3, and the contact portion 51 of the grounding terminal 5 disengages from contacting the plug.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An audio jack mounted on a printed circuit board for mating with a mating plug, comprising:

an insulative casing defining an interior space adapted to receive a pin of a mating plug, the casing having a bottom wall defining a recess in an inner side thereof in communication with the interior space, a rear face defining first and second sets of slots in communication with the interior space, and a side wall having a side face defining a window in communication with the recess via a vertical groove;

first and second sets of conductive terminals respectively received in the first and the second sets of slots and extending into the interior space; and a grounding terminal secured to the side wall, the grounding terminal having a horizontal plate portion extending in a first direction, a raised portion upwardly extending from said Plate portion in a second direction perpendicular to said first direction and received in said vertical groove, an upwardly extending contact portion extending from an upper end of said raised portion along a third direction perpendicular to both said first and second directions and extending through the window and upwardly extending into the interior space through the recess, a vertical portion downwardly extending from an outer portion of said plate portion in the fourth direction opposite to said second direction; and a solder pad horizontally extending from a lower portion of said vertical portion in a fifth direction opposite to said first direction and out of the side wall of the casing for being soldered to a printed circuit boards:

wherein the side wall of the insulative casing defines a slit in communication with the window via the vertical groove, and the horizontal plate portion received in the slit;

wherein the plate portion of the grounding terminal has a pair of resilient tabs for engaging with an inner side of the casing.

2. An audio jack assembly comprising:

an insulative housing defining an interior space;

a pin of a mating plug inserted into said interior space in a front-to-back direction;

a horizontal slit horizontally extending inward into the housing from one side wall thereof;

a window horizontally extending inwardly into the housing from said side wall above said slit;

a vertical groove extending inwardly into the housing from said side wall between and in communication with said slit and said window, respectively;

a grounding tang inserted into the housing from said side wall, said grounding tang including a horizontal plate portion with barbs thereon retained in said slit, a raised portion upwardly extending from said plate portion and received in said vertical groove, and a contact portion extending from an upper end of said raised portion and received in said window and further into said interior space and generally along said front-to-back direction; wherein said contact portion engages the pin.

* * * * *